US007041070B2

(12) United States Patent
Hsieh

(10) Patent No.: US 7,041,070 B2
(45) Date of Patent: May 9, 2006

(54) MASSAGING AND OSCILLATING DEVICE

(76) Inventor: Wen-Hsu Hsieh, No. 27, Lane 300, Tianshiang Rd., Changhua (TW)

( * ) Notice: Subject to any disclaimer, the term of this patent is extended or adjusted under 35 U.S.C. 154(b) by 0 days.

(21) Appl. No.: 10/958,603

(22) Filed: Oct. 5, 2004

(65) Prior Publication Data

US 2006/0074358 A1 Apr. 6, 2006

(51) Int. Cl.
*A61H 19/00* (2006.01)

(52) U.S. Cl. ..... 601/90; 601/133

(58) Field of Classification Search ..... 601/90–998
See application file for complete search history.

(56) References Cited

U.S. PATENT DOCUMENTS 4,981,131 A * 1/1991 Hazard ..... 601/24
6,213,962 B1 * 4/2001 Shimizu ..... 601/90
6,629,940 B1 * 10/2003 Shimizu ..... 601/133
2004/0005972 A1 * 1/2004 Sugiyama et al. ..... 482/148

* cited by examiner

*Primary Examiner*—Michael A. Brown
(74) *Attorney, Agent, or Firm*—Charles E. Baxley

(57) ABSTRACT

The present invention relates to a massaging and oscillating device which is capable of providing the user a massage like a real professional. A first and a second guide wheels are disposed between a left and a right massaging members and a drive shaft, the first guide wheel is slantingly disposed to form a deference massaging angle with respect to the second guide wheel. The left and the right massaging members are provided with a massaging airbag which is inflated and deflated in a predetermined way, the present invention can produce wave-like massaging effect. Furthermore, the massaging airbags can be adjusted flexibly according to personal requirements, such as, on the massaging force and manner of massaging.

5 Claims, 12 Drawing Sheets

MASSAGING AND OSCILLATING DEVICE

BACKGROUND OF THE INVENTION

1. Field of the Invention

The present invention relates to a massaging device, and more particularly to a massaging and oscillating device which is capable of improving massaging effect.

2. Description of the Prior Arts

Most of the massaging mechanisms sold on the market employ a drive shaft to rotate a left and a right massaging members, so as to massage the leg.

U.S. Pat. No. 6,629,940 B2 discloses a massaging device, as shown in FIG. 1, which uses a revolving shaft to rotate a left and a right drive cam assemblies 10, the left and the right cam assemblies 10 are slantingly arranged to form a deflection angle A, and each of the assemblies 10 comprises an outer cam 11 and an inner cam 12, respectively. The outer cam 11 and the inner cam 12 rotate in an opposite direction, a left and a right massaging members 13 are rotated by the left and the right cam assemblies 10 to massage the lower leg. The function and the massaging effect of this conventional massaging device cannot be adjusted any more once the deflection angle A is fixed. In addition, since the left and the right massaging members 13 only can massage the lower leg in a fixed direction and at a fixed angle relative to the lower leg, the massaging will not be effective.

U.S. Pat. No. 6,213,962B1 discloses a massaging device, as shown in FIGS. 2*a* and 2*b*, which employs a rotating shaft 15 to rotate the left and the right massaging members 16 having an deflection angle B in different directions and in different ways to massage the underside of the foot by cooperating with the massaging layer 17. Since the deflection angle B is not adjustable, the massaging will not be effective.

U.S. Pat. No. 6,599,261 discloses a massager, as shown in FIG. 3, which employs a rotating shaft 18 to rotate a left and a right massaging members 19 in the same direction, the left and the right massaging members 19 are provided on their surface with a plurality of massaging knobs 191 for massaging the shank of leg and the sole of foot. The deflection angle C of this massager also cannot be adjusted. The function and the massaging effect of this conventional massaging device will be fixed and cannot be adjusted once the deflection angle C is fixed. In addition, since the left and the right massaging members 19 only can massage the lower leg in a fixed direction and at a fixed angle relative to the lower leg, the massaging effect is not good.

The present invention has arisen to mitigate and/or obviate the afore-described disadvantages.

SUMMARY OF THE INVENTION

The primary object of the present invention is to provide a massaging and oscillating device which is capable of providing the user a massage like a real professional. A first and a second guide wheels are disposed between a left and a right massaging members and a drive shaft, the first guide wheel is slantingly disposed to form a deference massaging angle with respect to the second guide wheel. The left and the right massaging members are provided with a massaging airbag which is inflated and deflated in a predetermined way, the present invention can produce wave-like massaging effect. Furthermore, the massaging airbags can be adjusted flexibly according to personal requirements, such as, on the massaging force and manner of massaging.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
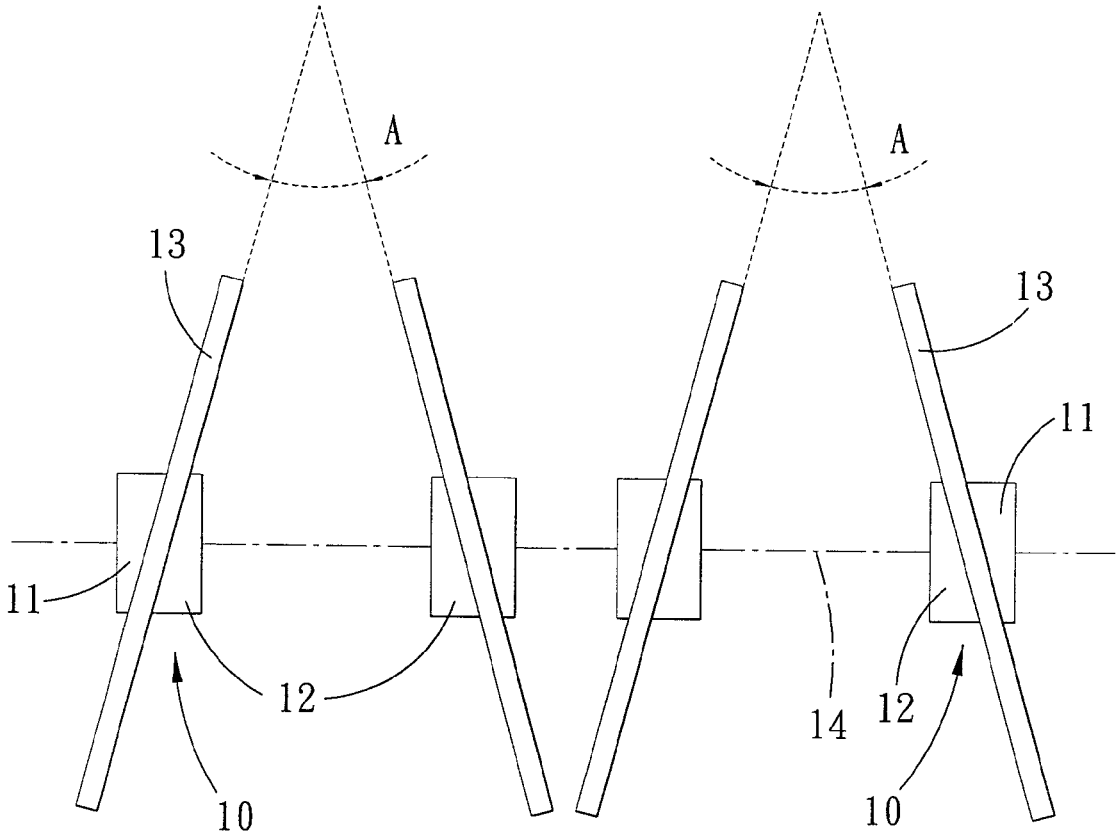
FIG. 1 is an operational view of a conventional massaging device.
Figure 2:
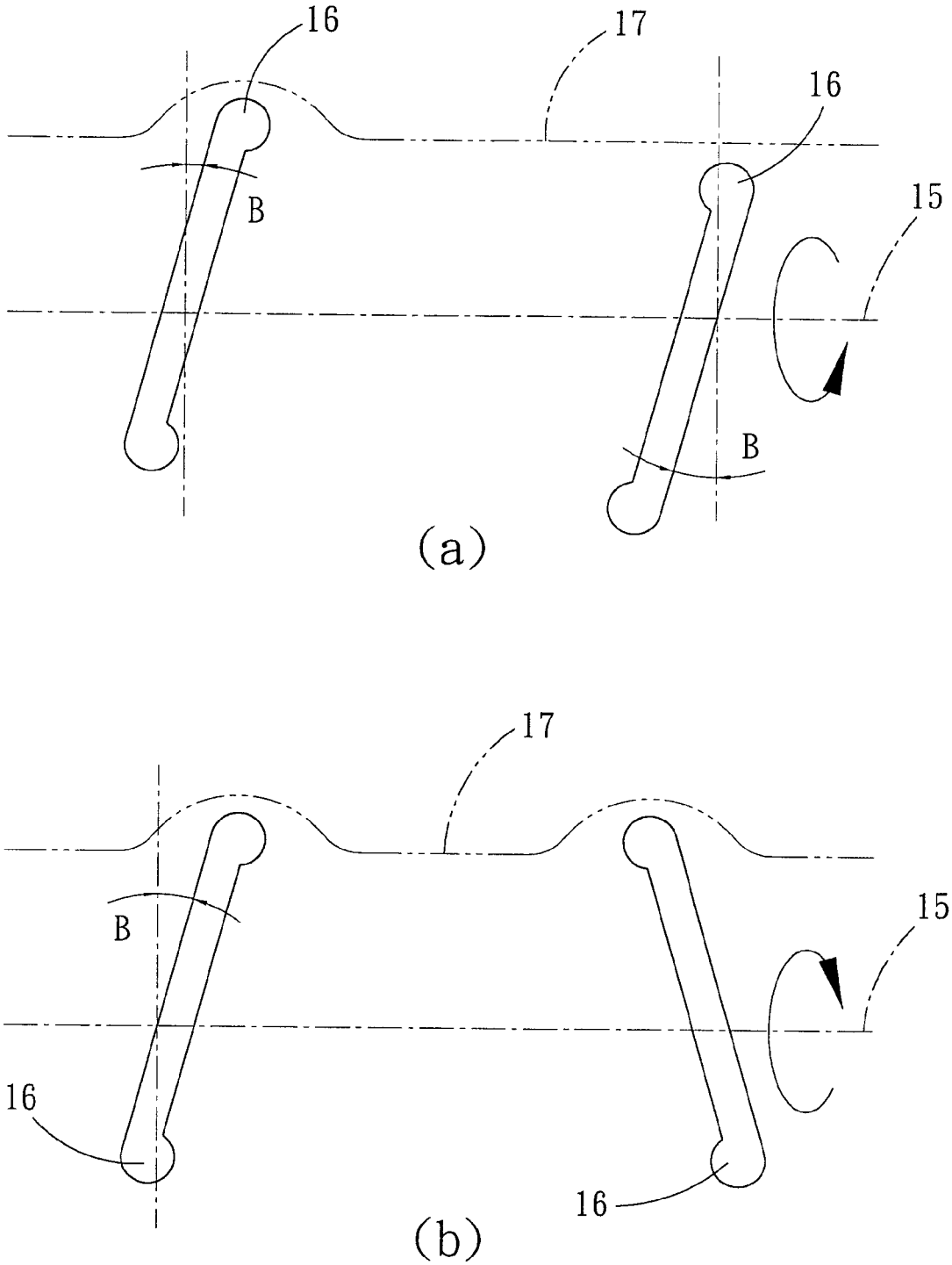
FIG. 2 is an operational view of another conventional massaging device.
Figure 3:
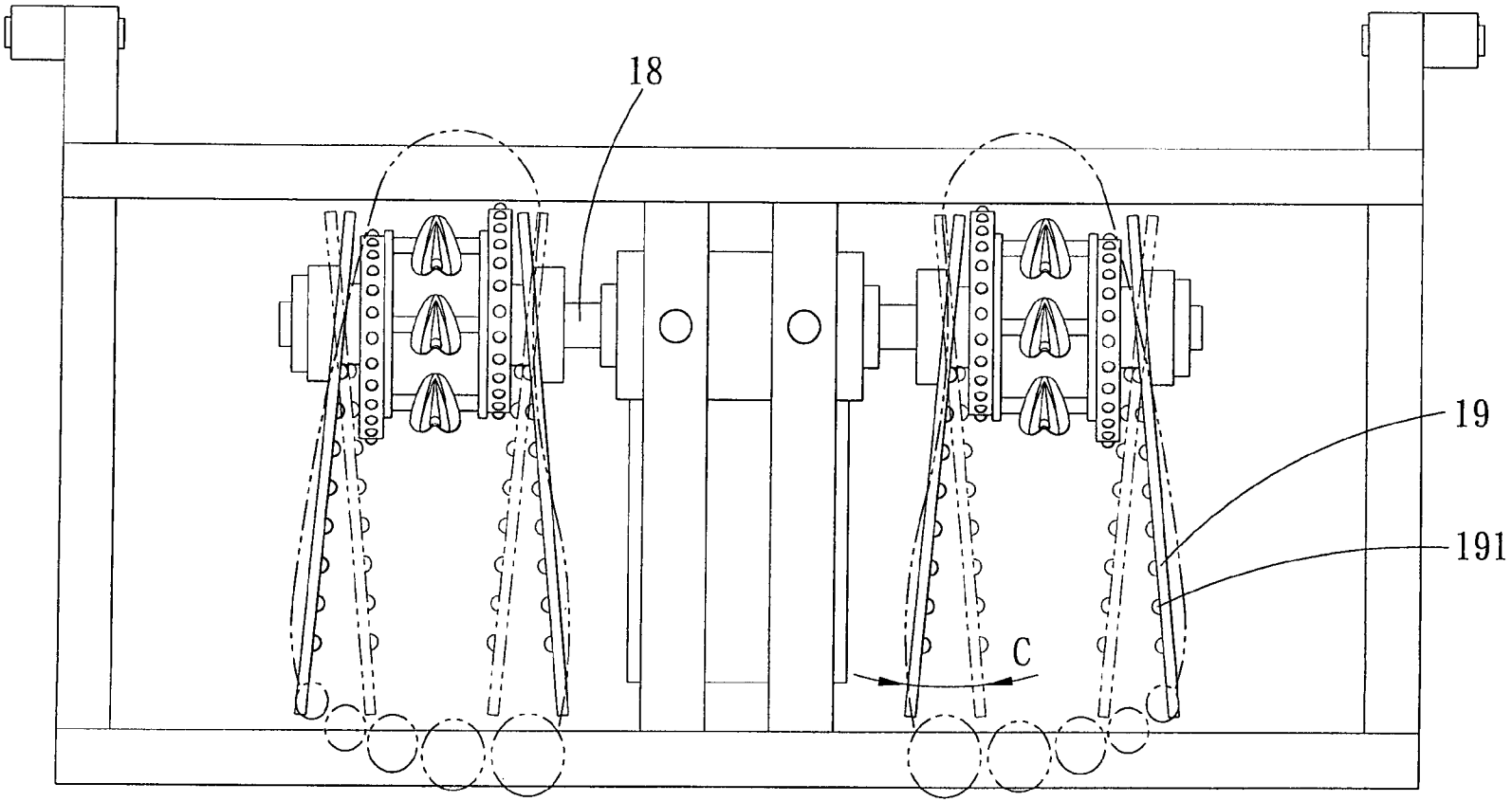
FIG. 3 is an assembly operational view of another conventional massaging device.
Figure 4:
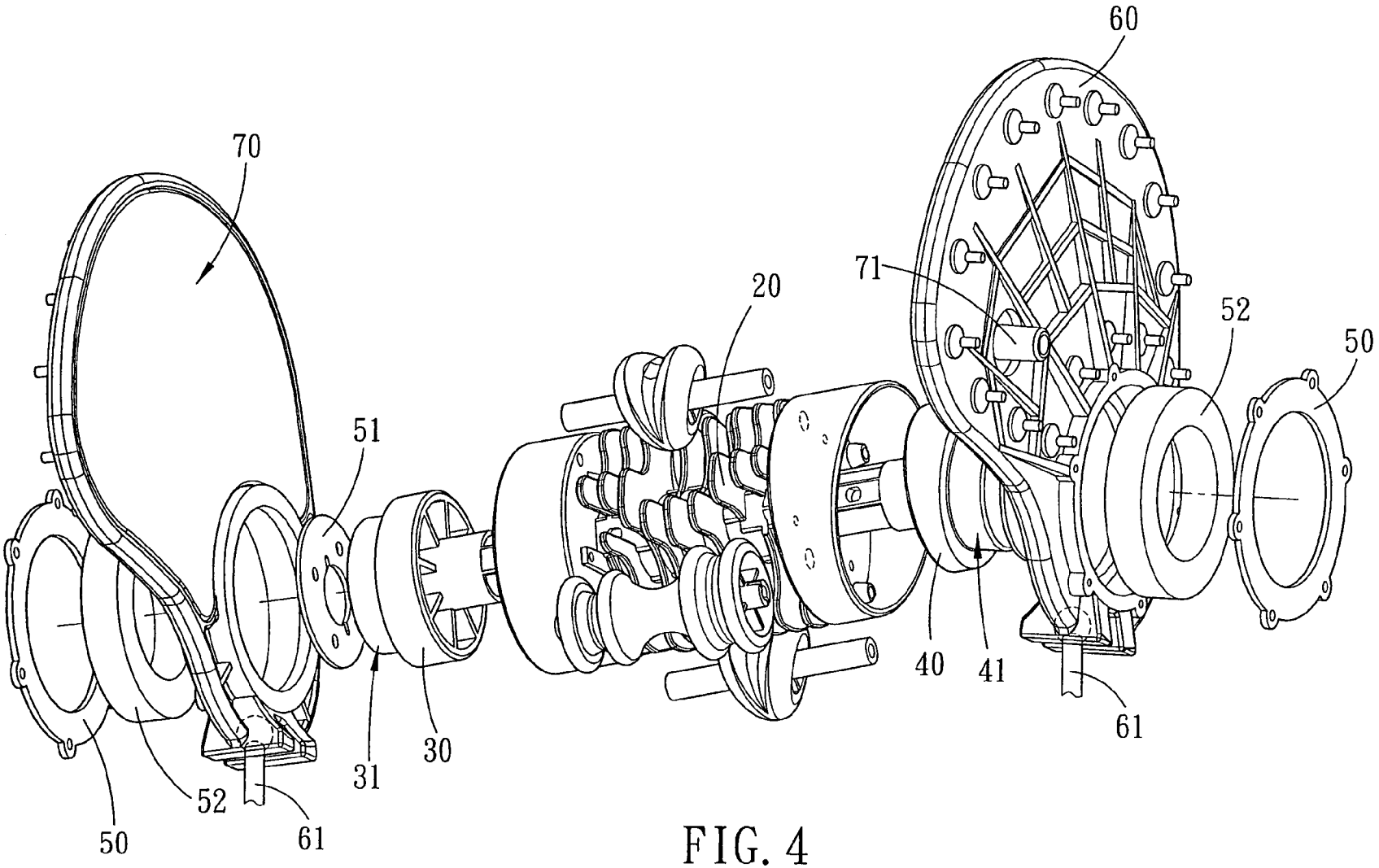
FIG. 4 is an exploded view of a massaging and oscillating device in accordance with a first embodiment of the present invention.
Figure 5:
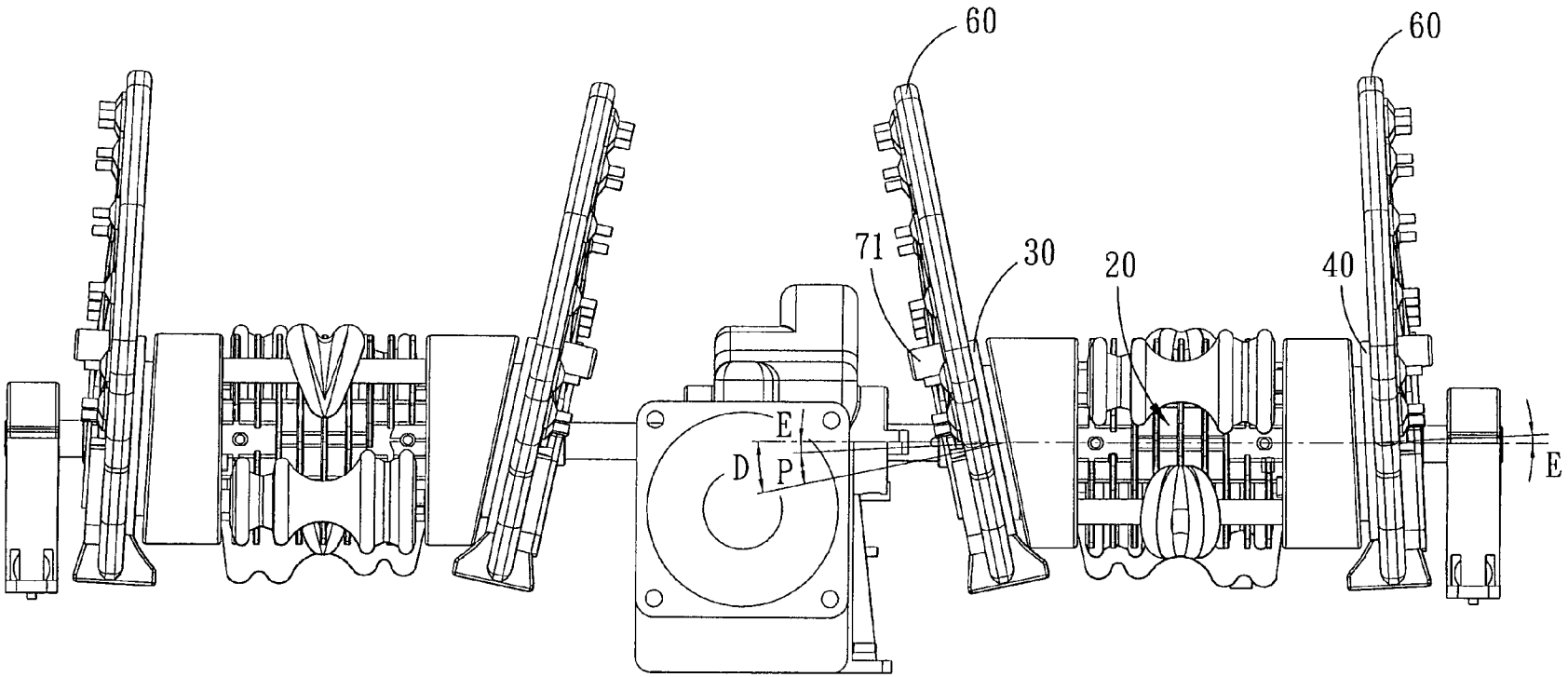
FIG. 5 is an operational view of a massaging and oscillating device in accordance with the first embodiment of the present invention.

Referring to FIGS. 4–8, a massaging and oscillating device in accordance with a first preferred embodiment of the present invention is installed in a housing F and generally comprises: a first and a second guide wheels 30, 40 mounted on a drive shaft 20, the first and the second guide wheels 30, 40 are equipped with a shaft bearing 52, respectively. The shaft bearings 52 employ a front and a rear locking plates 50, 51 to fix a left and a right massaging members 60, a side of the left and the right massaging members 60 is restricted by a pin 61 so that the left and the right massaging members 60 are only to oscillate but not to rotate.

The first guide wheel 30 is provided with a guide rail 31 which is slantingly disposed to form a first deflection angle D with respect to the drive shaft 20. The first guide wheel employs the shaft bearing 52, the front and the rear locking plates 50, 51 to fix a massaging member 60.

The second guide wheel 40 is provided with a guide rail 41 which is slantingly disposed to form a second deflection angle E with respect to the drive shaft 20. The second guide wheel employs the shaft bearing 52, the front and the rear locking plates 50, 51 to fix a massaging member 60.

Two massaging air bags 70 are installed on the surface of the massaging members 60 of the first and the second guide wheels 30, 40, respectively. A pipe 71 is used to control the inflation and deflation of the massaging air bags 70 in a predetermined way.

Figure 6:
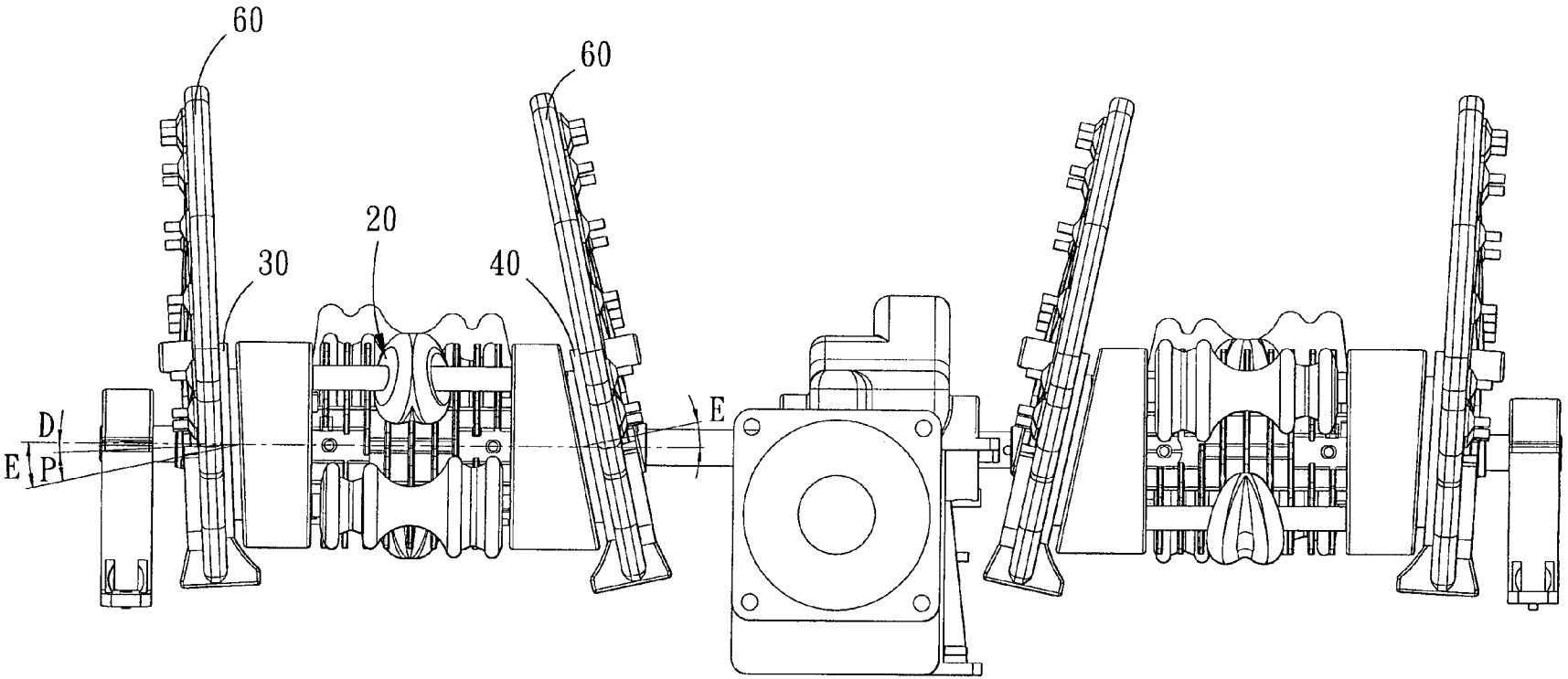
FIG. 6 is another operational view of a massaging and oscillating device in accordance with the first embodiment of the present invention.
Figure 7:
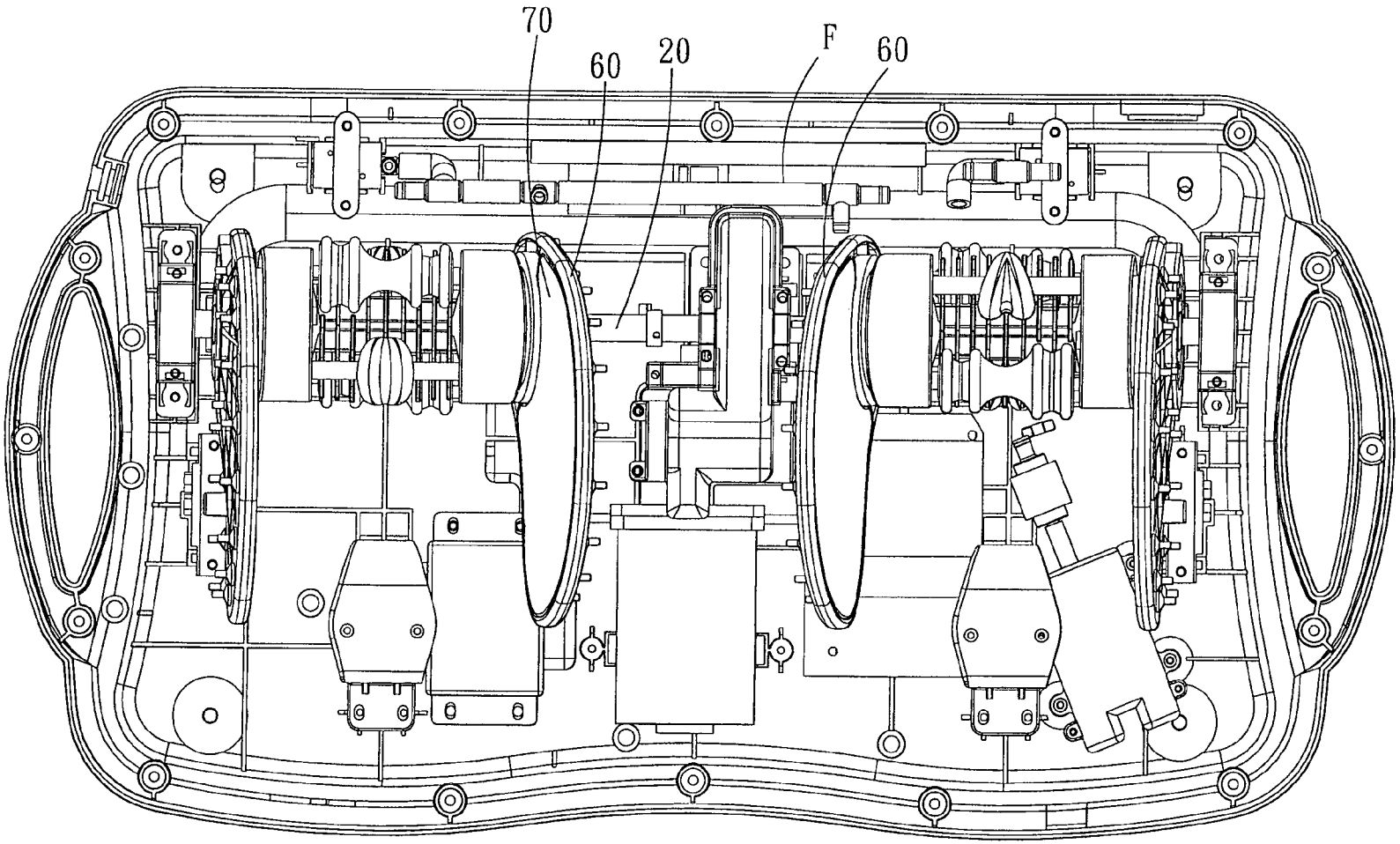
FIG. 7 is a top assembly view of a massaging and oscillating device in accordance with the first embodiment of the present invention.
Figure 8:
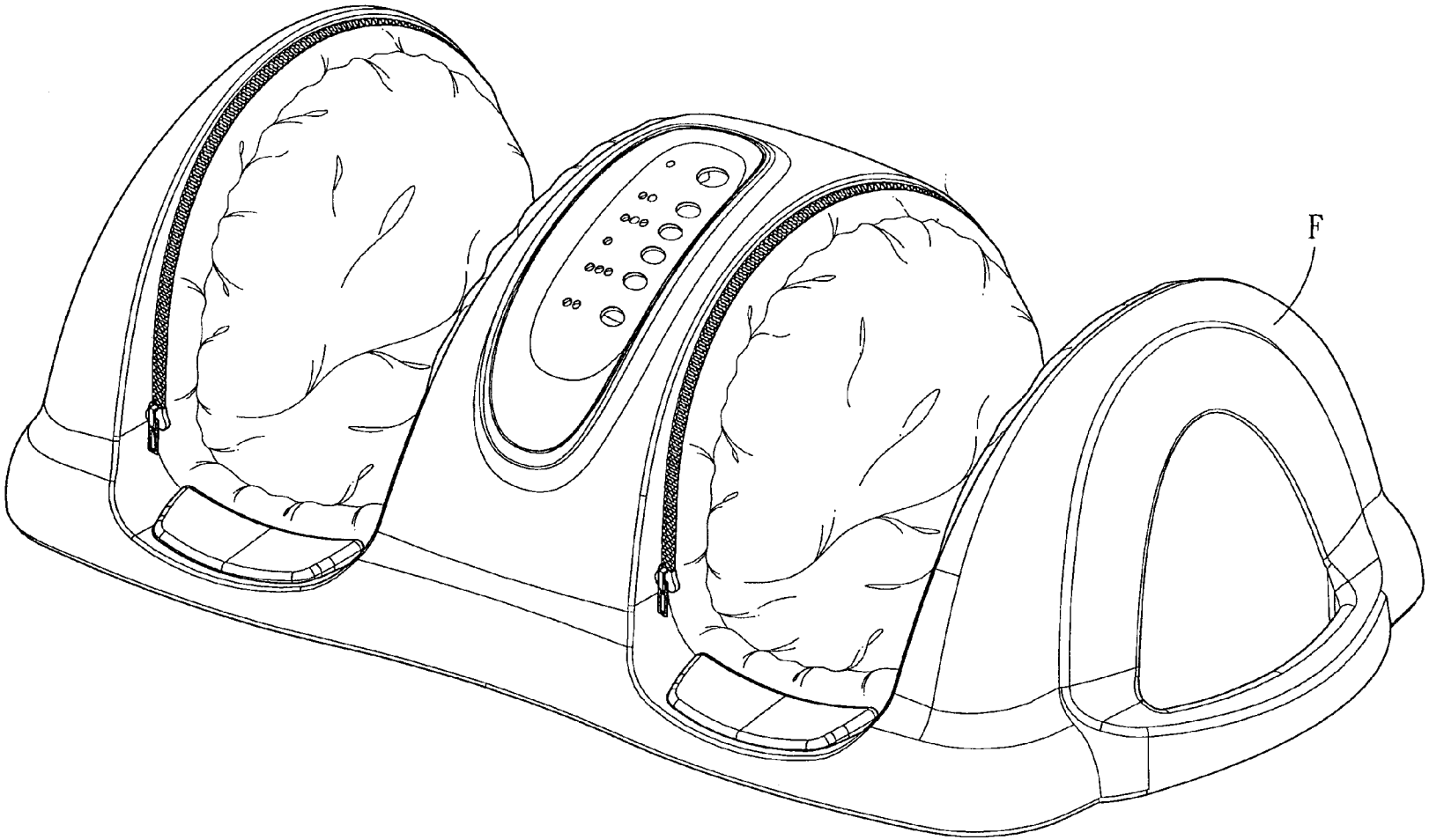
FIG. 8 is a perspective view of a massaging and oscillating device in accordance with the first embodiment of the present invention.

Referring particularly to FIGS. 6, 7 and 8, the drive shaft 20 will drive the first and the second guide wheels 30, 40 to rotate, and the left and the right massaging members 60 can oscillate only due to a side of massaging members 60 is restricted by a pin 61, the first and the second guide wheels 30, 40 will employ the shaft bearings 52 to make the left and the right massaging members 60 oscillate at different angles within the scope of the first deflection angle D and the second deflection angle E. In addition, the value of the first deflection angle D is different from that of the second deflection angle E, and the difference between the first deflection angle D and the second deflection angle E is an massaging angle P which enables the left and the right massaging members 60 to oscillate at different angles, thus creating a wave-like real massaging effect and massaging the muscle of the foot like a real person. In this case, the difference massaging angle P between the first deflection angle D and the second deflection angle E can enable the left and the right massaging members 60 to perform a wave-like motion, thus improving the massaging effect.

Figure 9:
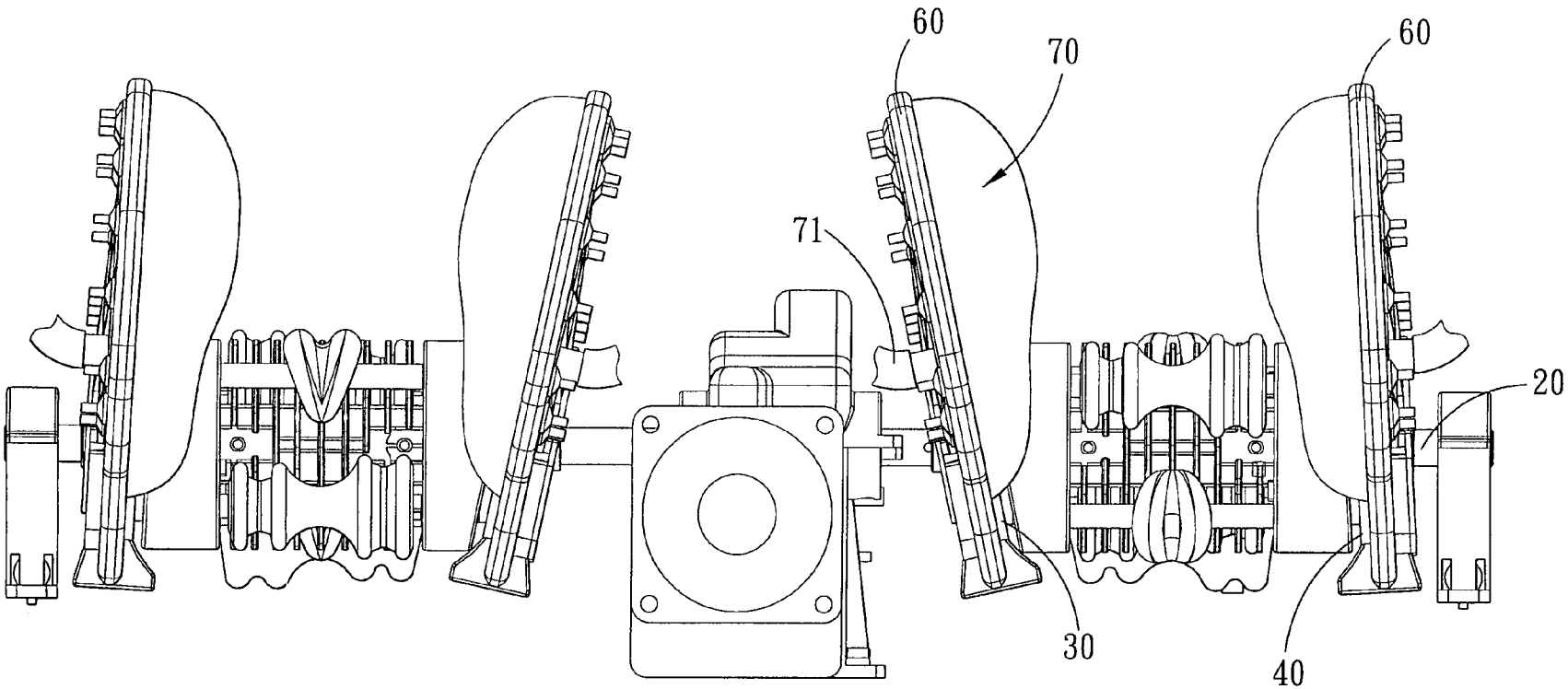
FIG. 9 is an operational view of a massaging and oscillating device in accordance with a second embodiment of the present invention.
Figure 10:
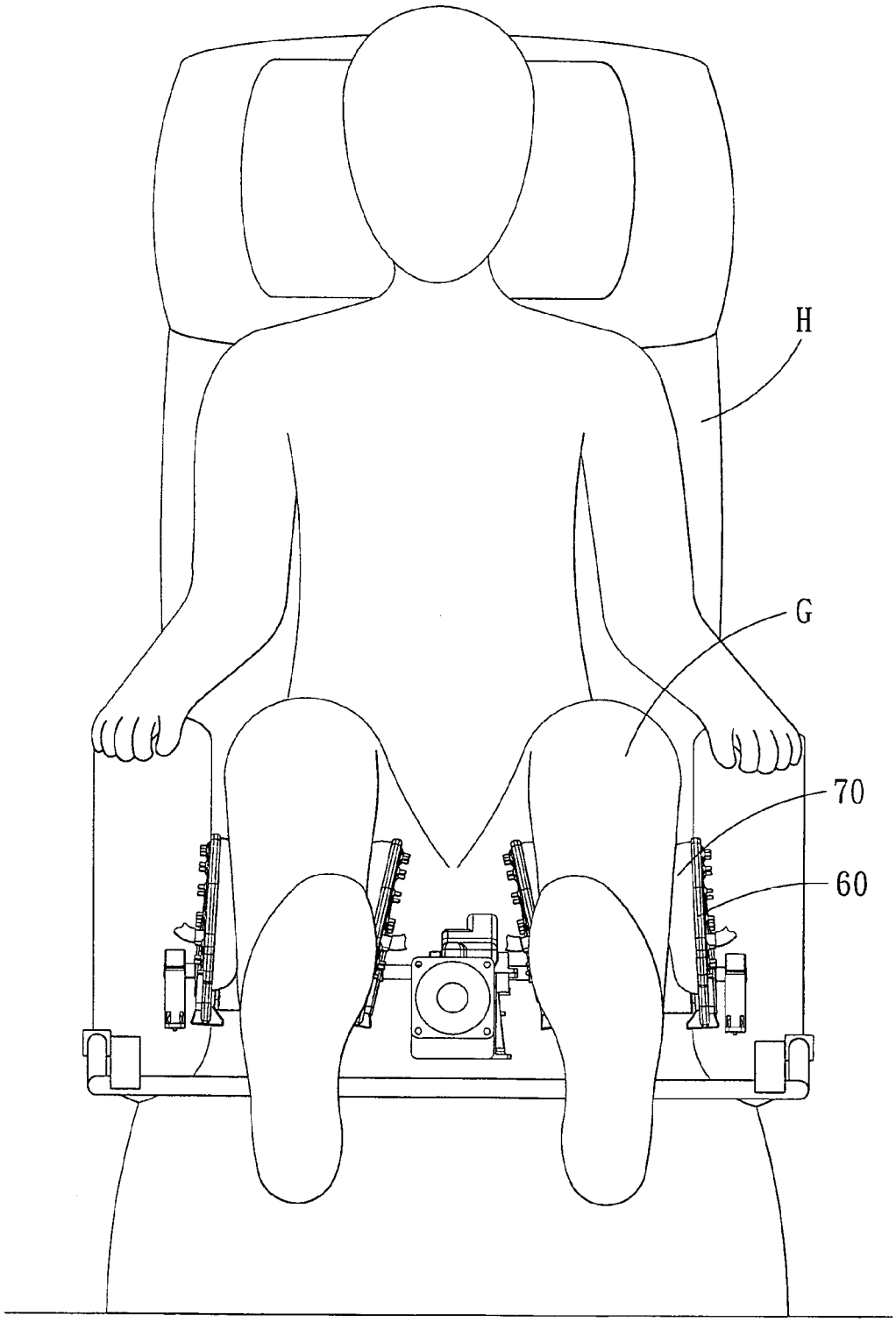
FIG. 10 is another operational view of a massaging and oscillating device in accordance with the second embodiment of the present invention.

Referring to FIGS. 9 and 10, a massaging and oscillating device in accordance with a second preferred embodiment of the present invention is normally installed on a massaging chair H, and also produces wave-like motion at different deflection angles so as to massage the lower leg G.

It will be noted that, besides the difference angle P, the massaging and oscillating device in accordance with the present invention is further provided at the opposite surfaces of the left and the right massaging members 60 with a massaging air bags 70, and a pipe 71 is used to control the inflation and deflation of the massaging air bags 70 in a predetermined way. Thus, the massaging and oscillating device not only can provide wave-like massaging effect, but also can give the user a massage like a real professional.

It should be noted that the above-mention massaging effect is achieved based on the following structural design:

First, the difference massaging angle P between the first deflection angle D of the first guide wheel 30 and the second deflection angle E of the first guide wheel 40.

Second, the massaging air bags 70 mounted on the massaging members 60, and a pipe 71 is used to control the inflation and deflation of the massaging air bags 70 in a predetermined way.

Various changes may be made in the detail construction, it is understood that such changes will be within the spirit and scope of the present invention.

Figure 11:
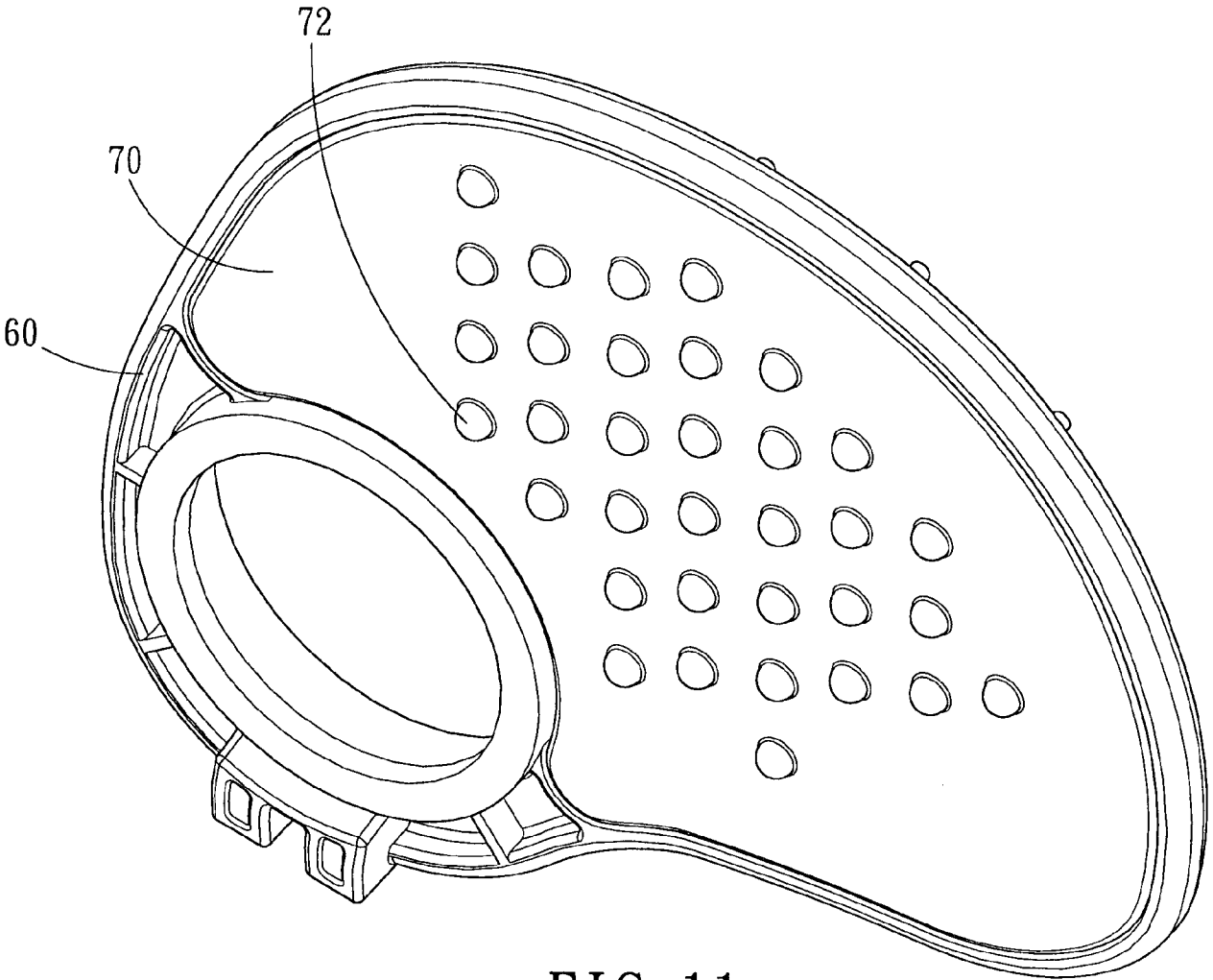
FIG. 11 is a partial perspective view of a massaging and oscillating device in accordance with a third embodiment of the present invention.
Figure 12:
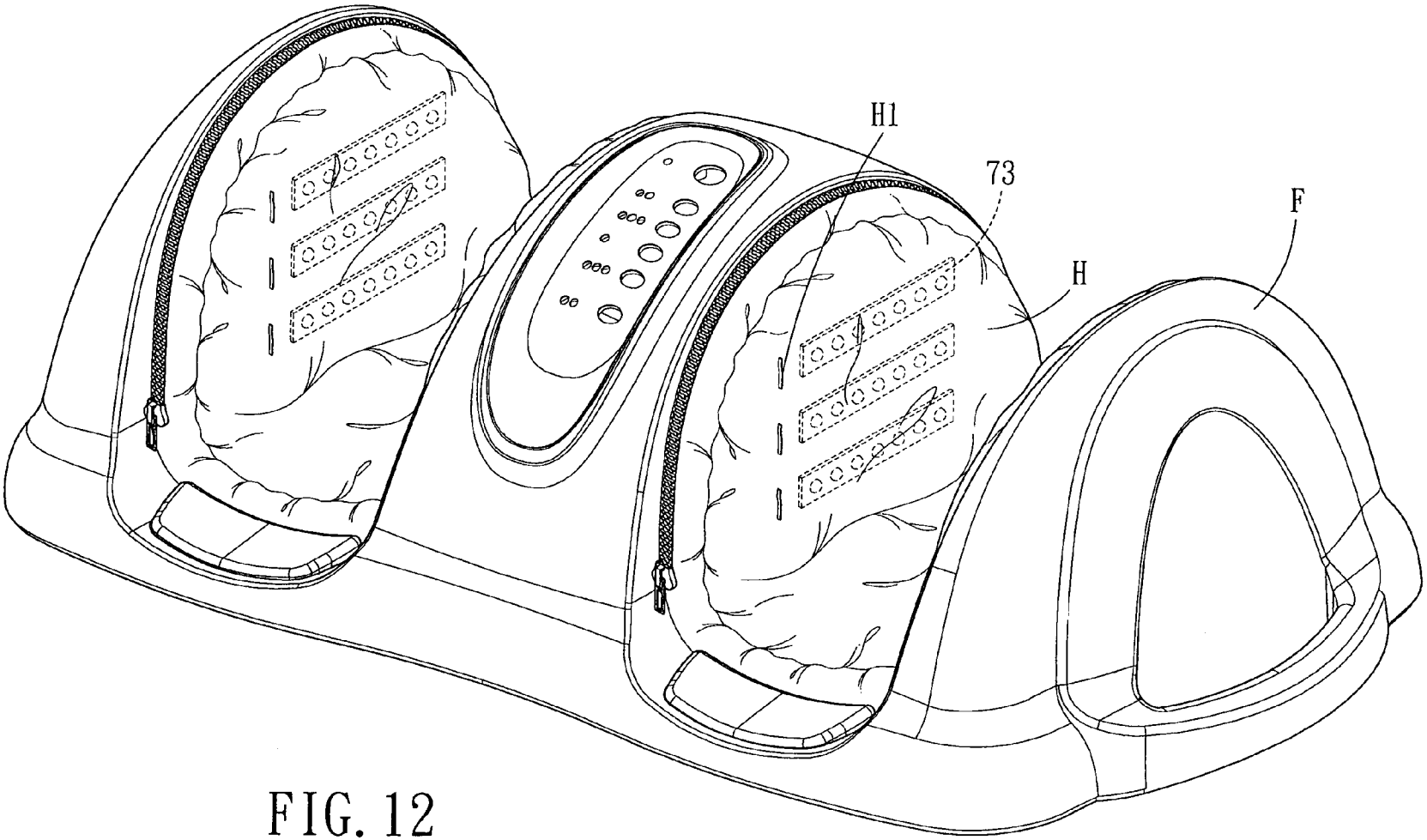
FIG. 12 is another partial perspective view of a massaging and oscillating device in accordance with a third embodiment of the present invention.

Referring to FIG. 11, which shows another embodiment of the present invention, on the surface of the massaging members 60 is provided with massaging air bags 70, and on the surface of the massaging air bags 70 are formed with massaging knobs 72 for improving the massaging effect. Referring to FIG. 12, the massaging knobs 72 can be replaced by the massaging blocks 73, the outer fabric layer I of the housing F can be provided with several layers of interlinings I1, thus, the massaging blocks 73 can be installed in the space between the interlinings I 1 (the shape and the number of the massaging blocks 73 can be adjusted according to the user's needs). Thus, the massaging effect of the present invention will be more versatile.

While we have shown and described various embodiments in accordance with the present invention, it should be clear to those skilled in the art that further embodiments may be made without departing from the scope of the present invention.

What is claimed is:

1. A massaging and oscillating device comprising:

a first and a second guide wheels mounted on a drive shaft, the first and the second guide wheels equipped with a shaft bearing, respectively, on which being fixed a left and a right massaging members, the left and the right massaging members restricted by a pin; wherein:

the first guide wheel is provided with a guide rail which is slantingly disposed to form a first deflection angle with respect to the drive shaft, the first guide wheel employs a shaft bearing to fix a massaging member;

the second guide wheel is provided with a guide rail which is slantingly disposed to form a second deflection angle with respect to the drive shaft, the value of the first deflection angle is different from that of the second deflection angle, and the difference between the first deflection angle and the second deflection angle is an massaging angle, the second guide wheel employs a shaft bearing to fix a massaging member;

a plurality of massaging air bags are installed on opposite surface of the massaging members of the first and the second guide wheels, respectively.

2. The massaging and oscillating device as claimed in claim 1, wherein the shaft bearings employ a front and a rear locking plates to fix the left and the right massaging members.

3. The massaging and oscillating device as claimed in claim 1, wherein a pipe is used to control inflation and deflation of the massaging air bags in a predetermined way.

4. The massaging and oscillating device as claimed in claim 1, wherein a plurality massaging knobs are formed on surface of massaging airbags.

5. The massaging and oscillating device as claimed in claim 1, wherein the massaging and oscillating device is installed in an independent housing which is provided with outer fabric layer, the outer fabric layer is provided with multiple layers of interlinings, a plurality of massaging blocks are installed in a space between the interlinings.

* * * * *